US005515413A

United States Patent [19]

Knudsen et al.

[11] Patent Number: 5,515,413

[45] Date of Patent: May 7, 1996

[54] X-RAY TUBE CATHODE CUP ASSEMBLY

[75] Inventors: Bruce A. Knudsen, Amsterdam, N.Y.; Clyde L. Briant, Barrington, R.I.

[73] Assignee: General Electric Company, Schenectady, N.Y.

[21] Appl. No.: 311,989

[22] Filed: Sep. 26, 1994

[51] Int. Cl.[6] ..... H01J 35/14

[52] U.S. Cl. ..... 378/136; 378/138

[58] Field of Search ..... 378/121, 134, 378/136, 137, 138, 139, 113, 141, 202

[56] References Cited

U.S. PATENT DOCUMENTS

| | | | |
|---|---|---|---|
| 3,194,625 | 7/1965 | Danko . | |
| 3,943,393 | 3/1976 | Naill | 378/136 X |
| 4,573,186 | 2/1986 | Reinhold | 378/136 X |
| 4,825,123 | 4/1989 | Franzel et al. | 378/136 X |
| 5,077,777 | 12/1991 | Daly | 378/136 |

FOREIGN PATENT DOCUMENTS

| | | | |
|---|---|---|---|
| 2675629 | 10/1992 | France | 378/138 |
| 0132983 | 11/1978 | Japan | 378/136 |
| 2260353 | 10/1990 | Japan . | |
| 0166840 | 12/1990 | Japan . | |
| 5314894 | 11/1993 | Japan . | |

*Primary Examiner*—David P. Porta
*Attorney, Agent, or Firm*—R. Thomas Payne; James Magee, Jr.

[57] ABSTRACT

An improved high performance x-ray system, having an improved cathode cup assembly which provides reduced tube manufacturing costs and reduces failures due to filament misalignment or sagging of the filament during both the manufacturing process and during operation, is disclosed.

18 Claims, 4 Drawing Sheets

X-RAY TUBE CATHODE CUP ASSEMBLY

RELATED APPLICATIONS

This application is related to commonly assigned U.S. patent application Ser. No. 08/299,166; (RD-23,413) of Knudsen et al., filed Aug. 22, 1994, and U.S. patent application Ser. No. 08/299,165 (RD-23,859) of Knudsen et al., filed Aug. 8, 1994, and U.S. patent application Ser. No. 08/311,988 (RD-23,926) of Knudsen et al., filed simultaneously herewith, the disclosure of each is incorporated herein by reference.

BACKGROUND OF THE INVENTION

The present invention relates to diagnostic and therapeutic radiology equipment and, more particularly, to improved cathode assemblies used in x-ray generating equipment, such as computerized axial tomography (C.A.T.) scanners. Most particularly, the invention is directed to improved x-ray tube cathode cup assemblies having a solid, one piece insulator unit.

Each x-ray tube is normally enclosed in an oil-filled protective casing. A glass envelope contains a cathode plate, a rotating disk target and a rotor that is part of a motor assembly that spins the target. A stator is provided outside the tube proximate to the rotor and overlapping therewith about two-thirds of the rotor length. The glass envelope is enclosed in an oil-filled lead casing having a window for the x-rays that are generated to escape the tube. The casing in some x-ray tubes may include an expansion vessel, such as a bellows.

X-rays are produced when, in a vacuum, electrons are released, accelerated and then abruptly stopped. This takes place in the x-ray tube. To release electrons, the filament in the tube is heated to incandescence (white heat) by passing an electric current through it. The electrons are accelerated by a high voltage (ranging from about ten thousand to in excess of hundreds of thousands of volts) between the anode (positive) and the cathode (negative) and impinge on the anode, whereby they are abruptly slowed down. The anode, usually referred to as the target, is often of the rotating disc type, so that the electron beam is constantly striking a different point on the anode perimeter. The x-ray tube itself is made of glass, but is enclosed in a protective casing that is filled with oil to absorb the heat produced. High voltages for operating the tube are supplied by a transformer. The alternating current is rectified by means of rectifier tubes (or "valves") in some cases by means of barrier-layered rectifiers.

For therapeutic purposes—e.g., the treatment of tumors, etc.—the x-rays employed are in some cases generated at much higher voltages (over 4,000,000 volts). Also, the rays emitted by radium and artificial radiotropics, as well as electrons, neutrons and other high speed particles (for instance produced by a betatron), are used in radio therapy.

X-ray tube performance can be affected by the alignment of the filament in the cathode assembly. Specifically, during x-ray tube manufacturing, it is important to be able to initially align the filament and have it stay aligned during completion of the manufacturing cycle and during operation of the x-ray tube.

Previously, coiled tungsten filaments used in x-ray tubes were assembled and then aligned in the cathode cup. Once assembled, the filaments were heated to about 2800° C. to produce the desired microstructure. During this heating, when assembled in the cathode cup, many filaments sagged and thus move out of alignment making it necessary to reseat them in the cathode cup and repeat the flashing or the heating to 2800° C. In some instances, this step had to be repeated up to as many as five (5) times until the filament alignment in the cathode cup was obtained with the desired microstructure.

A prior method of assembling the filament included an operator determining from a pattern the proper shape of each insulating flange so that each individual prior are insulator would fit into the cathode cup in accordance with the number of filaments to be positioned in the cathode cup. During the flange cutting, burs were sometimes formed on the flange edge. When the flange was connected to the cathode cup surface, such as by welding, the insulator was twisted out of proper alignment. Thus, after assembly of the filament in the twisted, misaligned insulator, the filament was misaligned sufficiently to cause x-ray failures.

Because of undetected insulator misalignment and the resulting misalignment of the filament(s), the need for a new insulator which reduced or eliminated filament alignment in the x-ray tube cathode cup became apparent. Thus, there is a need for an insulator member, preferably one piece, made of, for example, a ceramic material that is sized to slide into the cathode cup in a fixed position to provide proper filament alignment and thus at least reduce or eliminate failures related to filament misalignment due to insulator misalignment.

SUMMARY OF THE INVENTION

In carrying out the present invention in preferred forms thereof, we provide an improved insulator assembly for cathode cups for use in x-ray tubes, such as those incorporated in diagnostic and therapeutic radiology machines, for example, computer tomography scanners. Illustrated embodiments of the resulting x-ray cathode assembly and the cup having the insulator assembly housing the filament having an x-ray tube are described herein.

One aspect of the present invention is a one piece insulator member having provisions for at least one filament therein for assembly into an x-ray tube, the insulator assembly comprises: an insulator member having at least two apertures formed therein; and connecting means operatively connected to the insulator member, for operatively connecting the insulator member to a cathode cup.

Another aspect of the present invention includes an insulator member preferably made of alumina ceramic. The insulator member could also be made of zirconia ceramic or ceramic mixtures having alumina or zirconia therein.

Accordingly, an object of the present invention is to provide an improved x-ray system including an x-ray tube having an improved insulator assembly which facilitates proper assembly and alignment of the filament in the cathode assembly cup.

A further object of the present invention is to provide an x-ray tube which includes an improved cathode assembly Other objects and advantages of the invention will be apparent from the following description, the accompanying drawings and the appended claims.

DESCRIPTION OF THE PREFERRED EMBODIMENT

Figure 1A:
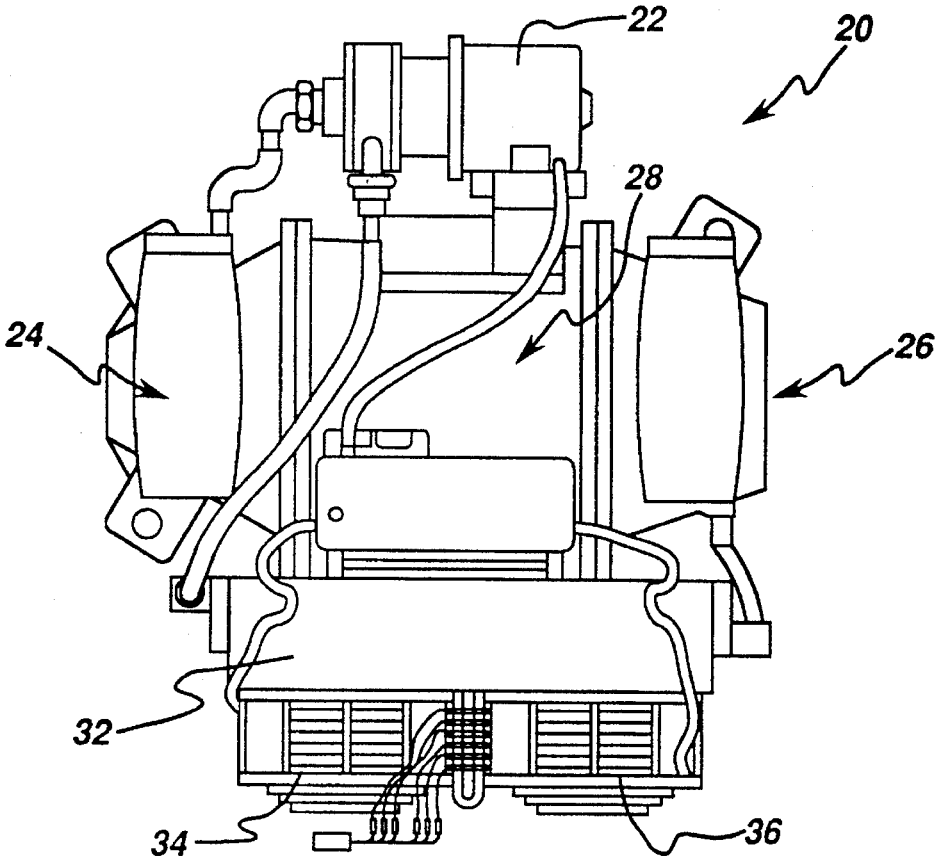
fig. 1a PRIOR ART
FIG. 1*a* is a plan view of a representative x-ray system.
Figure 1B:
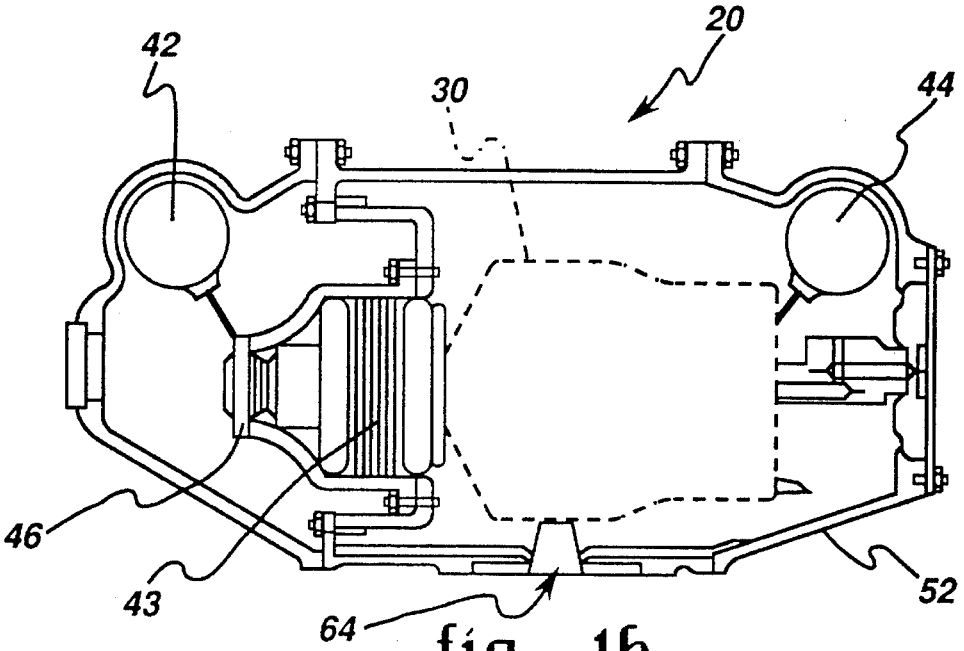
fig. 1b PRIOR ART
FIG. 1*b* is a sectional view with parts removed of the x-ray system of FIG. 1*a;*
Figure 2:
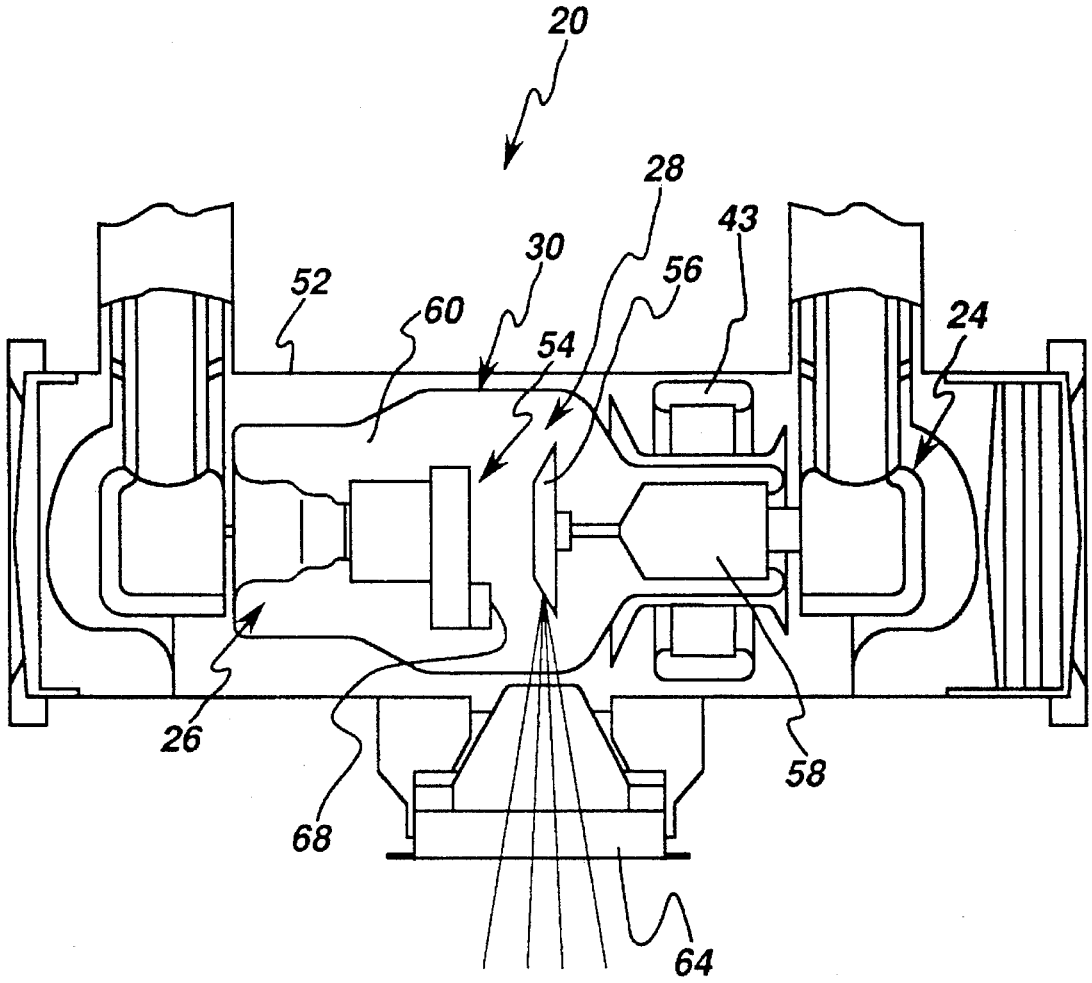
fig. 2 PRIOR ART
FIG. 2 is a schematic representation of another representative x-ray system having an x-ray tube positioned therein.

A representative x-ray system in which an x-ray tube made, in accordance with the present invention, by one preferred method thereof could be used, is illustrated as generally designated by the numeral 20 in FIGS. 1*a*, 1*b* and 2. As can be seen, the system 20 comprises an oil pump 22, an anode end 24, a cathode end 26, a center section 28 positioned between the anode end and the cathode end, which contains the x-ray tube 30. A radiator 32 for cooling the oil is positioned to one side of the center section and may have fans 34 and 36 operatively connected to the radiator 32 for providing cooling air flow over the radiator as the hot oil circulates therethrough. The oil pump 22 is provided for circulating the hot oil through the system 20 and through the radiator 32, etc. As shown in FIG. 1*b*, electrical connections are provided in the anode receptacle 42 and the cathode receptacle 44.

As shown in FIG. 2, the x-ray system 20 comprises a casing 52 preferably made of aluminum and lined with lead and a cathode plate 54, a rotating target disc 56 and a rotor 58 enclosed in a glass envelope 60. A stator 43 is positioned outside the glass envelope 60 inside the lead lined casing 52 relative to the rotor 58. The casing 52 is filled with oil for cooling and high voltage insulation purposes as was explained above. A window 64 for emitting x-rays is operatively formed in the casing 52 and relative to the target disc 56 for allowing generated x-rays to exit the x-ray system 20.

Figure 3:
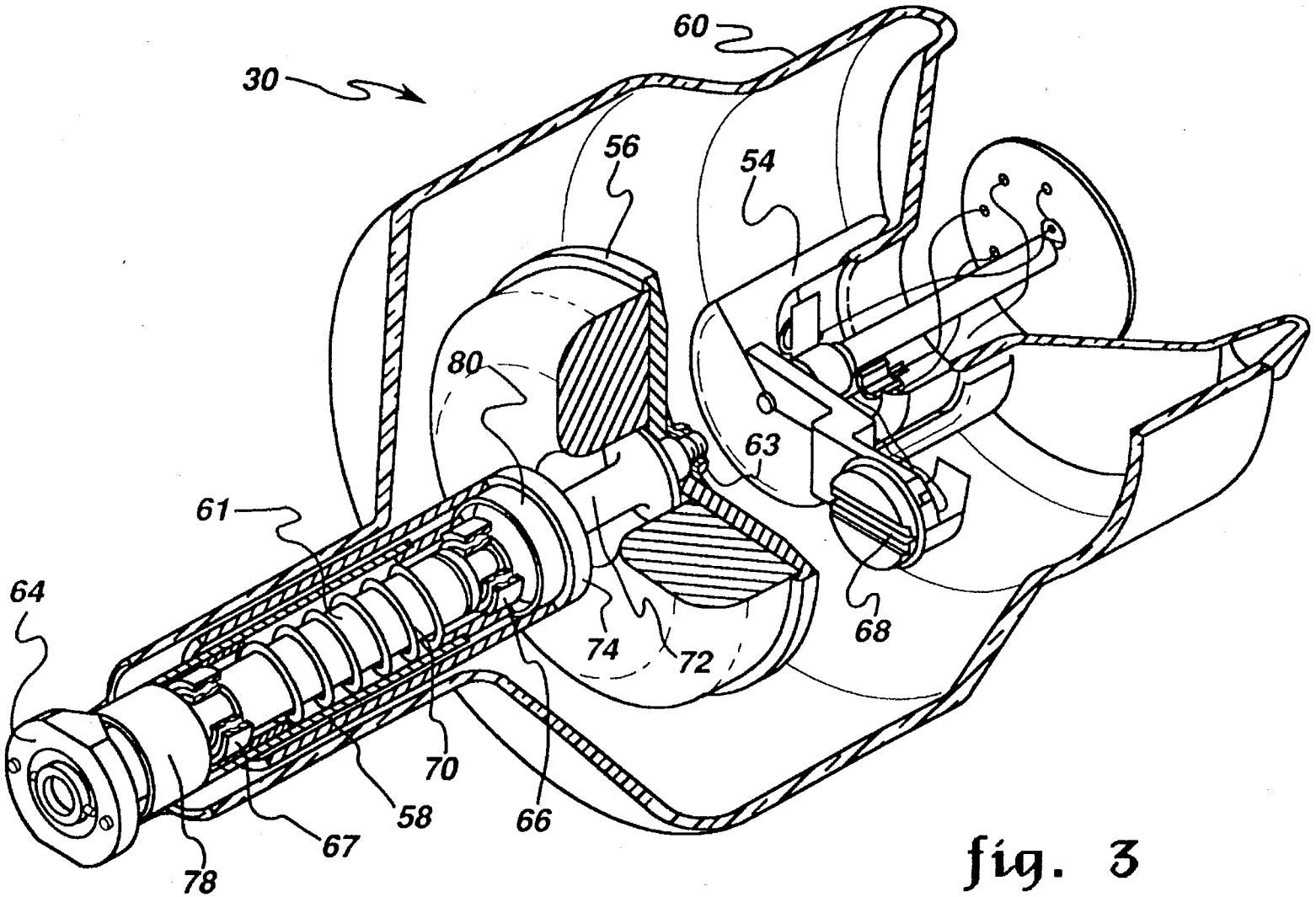
fig. 3 PRIOR ART
FIG. 3 is a partial perspective view of a representative x-ray tube with parts removed, parts in section, and parts broken away.

As shown in FIG. 3, the cathode 54 is positioned inside the glass envelope 60. As is well known, inside the glass envelope there is a vacuum of about $10^{-5}$ to about $10^{-9}$ torr. The electricity generates x-rays that are aimed from the cathode filament 68 to the anode target or the top of the target disc 56. The target disc is conventionally connected to a rotating shaft 61 at one end by a Belleville nut 63 and by another nut at the other end 64. A front bearing 66 and a rear bearing 68 are operatively positioned on the shaft 61 and are held in position in a conventional manner. The bearings 66 and 68 are usually lubricated and are susceptible to failure at high operating temperatures.

A preload spring 70 is positioned about the shaft 61 between the bearings 66, 68 for maintaining load on the bearings during expansion and contraction of the anode assembly. A rotor stud 72 is utilized to space the end of the rotor most proximate the target 56 from the rotor hub 74. The bearings, both front 66 and rear 68, are held in place by bearing retainers 78 and 80. The rotor assembly also includes a stem ring 82 and a stem 84 all of which help to provide for the rotation of the rotor 58 with the target 56.

The temperature in the area of the filament 69 can get as high as about 2500° C. Other temperatures include about 1100° C. near the center of the rotating target 56, which rotates at about 10,000 rpm. Temperatures of the focal spot on the target 56 can approximate 3200° C. and temperatures on the outside edge of the rotating target 56 approach about 1300° C. The temperature in the area of the rotor hub 74 approaches 700° C. and of the front bearing approaches 450° C. maximum. Obviously, as one moves from the target 56 to the rotor 58 and stator 43, the temperature appears to decrease.

Figure 4:
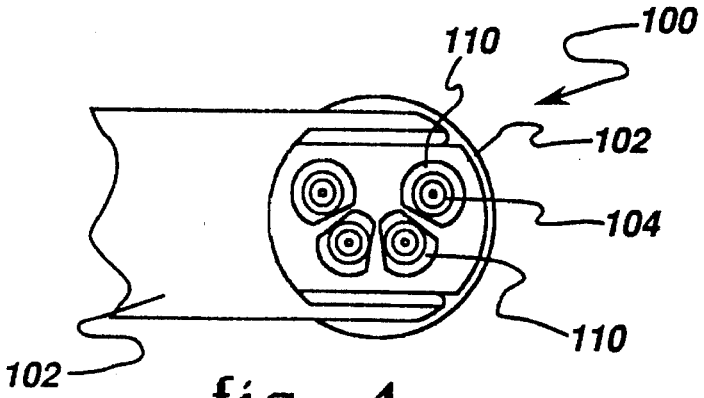
fig. 4 PRIOR ART
FIG. 4 is a plan view of a prior art embodiment of filament(s) assembled in the cathode cup of an x-ray tube.
Figure 5:
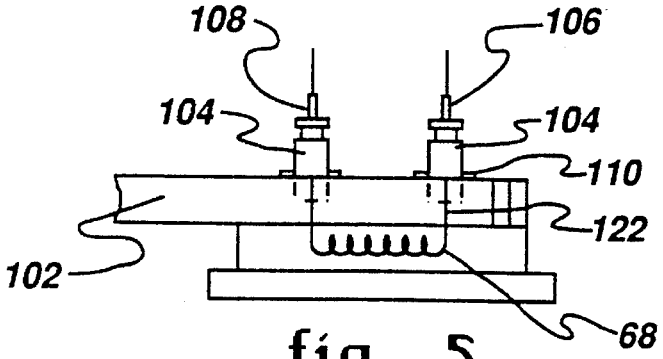
fig. 5 PRIOR ART
FIG. 5 is a side view of a prior art filament assembled in a cathode cup similar to that of FIG. 4.

Referring now to FIGS. 4 and 5, therein is shown a representative prior art cathode cup having filament(s) assembled therein, generally designated by the reference numeral 100. The cathode cup filament assembly 100 comprises a cup member 102, preferably of a metallic material and more preferably made of nickel, or other similar material having a melting temperature and heat transfer property similar to nickel, insulator members 104 preferably made of alumina, operatively positioned in apertures formed in the cup member 102, by conventional means such as by drilling, for receiving conductive rods 106, 108.

The rods 106, 108 are preferably made of Kovar and could be made from a material chosen from the group comprising: stainless steel or other rigid conductive material.

The prior insulator used in x-ray tubes to insulate the cathode filaments from the cathode are, as shown in FIGS. 4, 5, 6 and 6A individual ceramic/metal combination units. Each of the individual insulators comprises a Kovar tube placed in a ceramic tube with a metal to ceramic seal formed to hold the tube as well as a flange to the outside of the ceramic. The flange also has a metal to ceramic seal for holding the flange which forms the base that holds insulator down against the cathode cup. Once positioned in the cup, each flange is spot welded to the cathode cup. As is shown in the FIGS., a single filament cathode has two insulators, a two filament cathode has four insulators and a three filament cathode has six insulators.

During the assembly of the filament into the cathode cup, the individual insulators are placed one at a time in apertures in the cup and are then welded. The four and six insulator units require that all the flanges be cut so that they fit in the space provided on the surface of the cathode cup. This cutting process requires careful and often tedious work on the part of an operator in order to get the flanges in proper position and welded evenly so that the flanges are straight and parallel. Since the insulator(s) functions to hold the filaments, unless the insulator(s) are installed or assembled straight and parallel so that the filament legs are properly positioned relative to the cathode cup, the problem of filament misalignment can result in x-ray failures.

During the prior art manufacturing process the filament 68 was positioned in the stator cup 112 and then heated (flashed) to about 2800° C. In one prior manufacturing method, it was the heating "flash"step to 2800° C. that caused the coiled tungsten filaments to move out of alignment in the stator cup and to sag. Such a misaligned or sagged filament would result in an x-ray tube that produced out of focus x-rays and/or x-rays of an area that was outside the area expected or aimed. Also, such misalignment by as little as two (2) mils, caused overheating of the filament which resulted in tube failure, i.e., not producing a good quality x-ray. Another result of filament misalignment was filament shorting, which also resulted in poor quality x-rays.

Since the heating or "flash" step was accomplished with the filament positioned in the cathode cup, when the filament sagged or was misaligned, it was necessary for an operator or an assembler to realign the filament thereby adding additional costs in the form of increased manufacturing time and increased labor to properly locate the filament in the cathode cup.

Specifically, during the prior manufacturing process, when the filament was found to be out of alignment specification, an operator would reposition it with tweezers or other small precision tools by bending and twisting the filament as necessary. During this operation, it was not unusual for filaments to break off because the adjustments to place the filament within specifications was greater than the filament's recrystalized condition would allow due to the filament being brittle after being heated to about 2800° C.

Once the operator or assembler successfully repositioned the filament, it was again necessary to reflash the filament to 2800° C. in order to provide the desired microstructure which includes being fully recrystalized and having large grain interlocking to provide creep resistance at high temperatures. Once the filament was properly aligned and the desired microstructure was in place, the cathode could then be assembled into the x-ray tube assembly.

If the filament were installed in the cathode cup and then heated before it was recrystalized, the filament would expand (get longer) and bow, sag or bend because the filament legs were held so tight in the cathode cup during the expansion caused by the application of heat thereto. In this condition, failure would be very likely.

One additional source of filament misalignment has been determined to be related to the connection of the insulator flange to the cathode cup surface. Such misalignment resulted from burs being formed on the flange material during the cutting process. These burs are believed to be a direct cause of the insulation being twisted during the connection of the insulation flange to the surface of the cathode cup, such as by welding. When a filament is positioned in the twisted, misaligned insulator, there is a high probability that the filament would become misaligned thereby resulting in the failures, as mentioned above.

Figure 6:
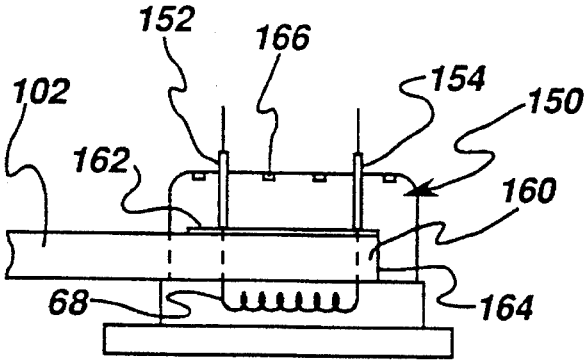
FIG. 6 is a side view of the filament assembly in the cathode and of the present invention.
Figure 7:
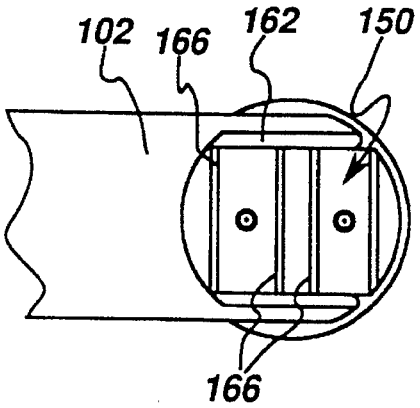
FIG. 7 is a plan view of the filament assembly of FIG. 6.

As shown in FIGS. 6 and 7, a unitary member or a solid one piece insulator member 150 preferably made of alumina having tubes 152, 154, preferably Kovar, sealed in place at fixed and parallel positions is illustrated. While the unitary member 150 shown has only two tubes holding the legs 160 of the filament, four or six tubes, depending on the x-ray tube in which the cup 102 was to be installed. It is understood that the present invention also includes cathode tubes having two, four or more filaments per cathode cup.

In making the ceramic insulator member 150, the ceramic insulator member 150 would be sized to slide into the cathode cup 102 frame until it contacted a cup 102 positioning means or the edge 164 of the cup 102, where the insulator position would be fixed, and the apertures in the insulator member 150 and the cathode cup 102 would be aligned so that any filament 68 positioned therein would be straight and parallel. The ceramic insulator member 150 includes tabs 162, preferably metal, operatively connected to the ceramic insulator member 150 which serve as hold down tabs to maintain the insulator member 150 in position relating to the cathode cup 102. The flat surfaces on the ceramic insulator member 150 and on the cathode cup 102 prevent the ceramic member 150 from becoming misaligned after the hold down tabs 162 were operatively connected to the cathode cup 102, such as by welding brazing, etc.

During fabrication of the ceramic insulator member 150, circles or grooves 166 are cast or formed to prevent solid surface coating, as done in the prior art. As is known, circles or grooves prevent arching by disrupting the electrical path along the surface of the insulators.

Having the insulator member 150 fixed against the cathode cup 102 surface with the apertures in the insulator member 150 and the cathode cup 102 aligned ensures proper filament alignment when an operator places the filament legs 160 into the cathode cup 102 and the tubes 152, 154 in the insulator member 150.

The one piece ceramic insulator member 150 having the tubes 152, 154 formed therein eliminate the prior need for the operator to cut each individual insulator flange 110 to proper size and also eliminate the setup and welding of each individual insulator 104 to the cathode cup 102. With the one piece ceramic insulator member 150 design of the present invention, flange cutting devices and alignment dyes are eliminated thus saving not only the operators time but also the cost of the equipment and equipment maintenance, thereby increasing manufacturing productivity.

While the products disclosed herein constitute preferred embodiments of the invention, it is to be understood that the invention is not limited to these precise products, and that changes may be made therein without departing from the scope of the invention which is defined in the appended claims.

What is claimed is:

1. An x-ray tube comprising:

an envelope;

a cathode, operatively positioned in the envelope;

an anode assembly including a rotor and a stator, operatively positioned relative to the cathode;

a target, operatively positioned relative to the cathode and operatively connected to the anode assembly; and a cathode cup assembly comprising:

a cup member, operatively connected to the cathode;

a one piece insulation member having at least two apertures formed therein and at least one hold down tab for operatively connecting the insulation member to the cup member; and at least one filament member operatively positioned in the combination insulator-cathode cup.

2. The x-ray tube of claim 1, wherein the insulator member comprises: a ceramic material.

3. The x-ray tube of claim 4, wherein the insulator member comprises a material chosen from the group consisting of alumina, zirconia or their mixtures.

4. The x-ray tube of claim 1, wherein the insulator member comprises: alumina.

5. An x-ray system comprising;

an enclosure;

at least one cooling means, operatively connected to the enclosure, for cooling the system;

an x-ray tube, operatively positioned inside the enclosure, for generating and directing x-rays toward a target, the x-ray tube comprising:

an envelope;

a cathode, operatively positioned in the envelope;

an anode assembly including a rotor and a stator, operatively positioned relative to the cathode;

a target, operatively positioned relative to the cathode and operatively connected to the rotor; and a cathode cup assembly comprising:

a cup member operatively connected to the cathode;

an insulator member having at least two apertures formed therein and at least one hold down tab for operatively connecting the insulator member to the cup member; and at least one filament member operatively positioned in the insulator member/cup member combination.

6. The x-ray system of claim 5, wherein the insulator member comprises: a ceramic material.

7. The x-ray system of claim 5, wherein the insulator member comprises a material chosen from the group consisting of: alumina, zirconia or their mixtures.

8. The x-ray system of claim 5, wherein the insulator member comprises: alumina.

9. An x-ray tube cathode cup combination comprising:

a cup member operatively connected to the cathode;

a one-piece ceramic insulator member having at least two apertures formed therein operatively connected to the cup member for receiving at least one filament therein; and at least one hold down tab, operatively connected to the insulator member for operatively connecting the one piece insulator member to the cathode cup member.

10. The cathode cup combination of claim 9, wherein the insulator member comprises: a material chosen from the group consisting of: alumina, zirconia or their mixtures.

11. The cathode cup combination of claim 9, wherein the insulator member comprises: alumina.

12. The cathode cup combination of claim 9, wherein the insulation member includes connecting means, operatively connected thereto, for operatively joining the insulation member to the surface of the cathode cup.

13. The cathode cup combination of claim 12, wherein the connection means comprises: hold down tabs compatible with both the insulation member material and the cathode cup material.

14. An x-ray tube cathode cup comprising:

a one piece insulator structure;

a cathode cup structure;

at least one hold down tab, operatively connected to the insulator structure, for operatively connecting the one piece insulator structure to the cathode cup structure; and at least one filament operatively positioned in the combination insulator structure/cathode cup structure such that the filament is properly aligned therein.

15. The cathode cup of claim 14, wherein the insulator structure comprises a ceramic alumina alloy.

16. The cathode cup of claim 14, wherein the insulator structure comprises:

about one-hundred percent ceramic alumina material.

17. An x-ray tube cathode cup comprising:

a cathode cup member having apertures therein; and a one-piece insulator member having apertures formed therein and at least one hold down tab connected thereto, the insulator member being operatively positioned on the cathode cup member so that the apertures in each are aligned.

18. The cathode cup of claim 17 further comprising:

at least one filament operatively positioned in the cathode cup wherein the filament legs are inserted through the apertures in the cathode cup and into conductive tubes operatively positioned in the insulator member.

* * * * *